US012584289B2

(12) United States Patent
Yonekura et al.

(10) Patent No.: US 12,584,289 B2
(45) Date of Patent: Mar. 24, 2026

(54) CONSTRUCTION MACHINE

(71) Applicant: Yanmar Holdings Co., Ltd., Osaka (JP)

(72) Inventors: Kiyoshi Yonekura, Chikugo (JP); Kohei Okazaki, Chikugo (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 429 days.

(21) Appl. No.: 18/028,151

(22) PCT Filed: Sep. 29, 2021

(86) PCT No.: PCT/JP2021/035949

§ 371 (c)(1),
(2) Date: Mar. 23, 2023

(87) PCT Pub. No.: WO2022/071426

PCT Pub. Date: Apr. 7, 2022

(65) Prior Publication Data

US 2023/0265639 A1 Aug. 24, 2023

(30) Foreign Application Priority Data

Sep. 30, 2020 (JP) ..... 2020-165134

(51) Int. Cl.
*E02F 9/00* (2006.01)
*E02F 9/12* (2006.01)

(52) U.S. Cl.
CPC ..... *E02F 9/12* (2013.01); *E02F 9/006* (2013.01)

(58) Field of Classification Search
CPC ..... E02F 9/12
See application file for complete search history.

(56) References Cited

U.S. PATENT DOCUMENTS

2021/0114451 A1* 4/2021 Yamamoto ..... E02F 9/0891

FOREIGN PATENT DOCUMENTS

| | | | | |
|---|---|---|---|---|
| EP | 0494070 | A2 * | 7/1992 | ..... E02F 9/2267 |
| JP | 074658/1994 | U | 10/1994 | |
| JP | 2589637 | Y2 * | 2/1999 | |
| JP | 2000008417 | A * | 1/2000 | ..... F16L 27/08 |
| JP | 2004244966 | A | 9/2004 | |
| JP | 2007-077768 | A | 3/2007 | |
| JP | 2008008009 | A | 1/2008 | |
| JP | 4343887 | B2 * | 10/2009 | |
| JP | 2011-196071 | A | 10/2011 | |
| JP | 2012225048 | A * | 11/2012 | |

(Continued)

OTHER PUBLICATIONS

JP 4343887, English Translation (Year: 2009).*

(Continued)

*Primary Examiner* — Karen Beck
(74) *Attorney, Agent, or Firm* — NORTON ROSE FULBRIGHT US LLP

(57) ABSTRACT

This construction machine includes a lower traveling body; an upper swiveling body; and a rotary coupling member that swivels, together with the upper swiveling body, with respect to the lower traveling body. The rotary coupling member has a swivel joint; a rotary joint that includes a slip ring; a cable; a coupling part; and a detent part that is fixed to the body of the swivel joint and that restricts the rotation of a terminal part of the slip ring.

12 Claims, 10 Drawing Sheets

(56) References Cited

FOREIGN PATENT DOCUMENTS

| | | | | |
|---|---|---|---|---|
| JP | 5420458 | B2 | | 2/2014 |
| JP | 2014095183 | A | * | 5/2014 |
| JP | 2020-012255 | A | | 1/2020 |
| JP | 2020002726 | A | * | 1/2020 |

OTHER PUBLICATIONS

Fukuda et al. JP 2012 225048, Machine English Translation, ip.com. (Year: 2012).*

T. Iijima, JP 2000 008417 Machine English translation, ip.com (Year: 2000).*

Japanese Office Action dated Feb. 20, 2024 issued in JP Application No. 2023-145526.

European Patent Office Action dated Oct. 10, 2024 issued in EP Application No. 21875723.5.

International Search Report dated Nov. 9, 2021 issued in corresponding PCT Application PCT/JP2021/035949.

* cited by examiner (a)

(b)

(a)

(b)

CONSTRUCTION MACHINE

CROSS-REFERENCE TO RELATED APPLICATIONS

This application is a national stage application pursuant to 35 U.S.C. § 371 of International Application No. PCT/JP2021/035949, filed on Sep. 29, 2021, which claims priority under 35 U.S.C. § 119 to Japanese Patent Application No. 2020-165134 filed on Sep. 30, 2020, the disclosures of which are hereby incorporated by reference in their entireties.

TECHNICAL FIELD

The present invention relates to a construction machine.

BACKGROUND ART

A hydraulic shovel, which is a typical example of construction machines, is generally equipped with a lower traveling body capable of self-traveling and an upper swiveling body with a work machine swivelably mounted on the lower traveling body via a swiveling device. Furthermore, in a typical hydraulic shovel, an earth removal device with a blade (earth removal plate) extending in a left-right direction is installed on a front side of a truck frame that constitutes the lower traveling body, and the earth removal device is used to perform an earth removal operation for earth, sand, or the like and a ground leveling operation for a developed land, a road, or the like.

A ground leveling operation system is known in which an earth removal device mounted on a hydraulic shovel is controlled in accordance with three-dimensional data of a ground to be constructed (refer to Patent Literature 1). A construction machine disclosed in the Patent Literature 1 is equipped with a prism and a tilt sensor to detect a position and a posture of a blade attached to the hydraulic shovel. Since a controller is disposed in an upper swiveling body of the construction machine, authentication signals are output from the controller to the prism via a cable at a side of the blade, a cable at a side of the swiveling body, and a relay connector. In addition, signals detected at the tilt sensor are output to the controller via the cable at the side of the blade, the cable at the side of the swiveling body, and the relay connector.

CITATION LIST

Patent Literature

Patent Literature 1: Japanese Unexamined Patent Application Publication No. 2020-12255

DISCLOSURE OF INVENTION

Problems to be Solved by the Invention

In a construction machine of Patent Literature 1, a controller is disposed in an upper swiveling body, and a tilt sensor and a prism are connected to the upper swiveling body via a cable at a swiveling side. Therefore, when the upper swiveling body swivels with respect to the lower traveling body, the cable at the swiveling side also moves significantly. In this case, an electrical connection between the upper swiveling body and the lower traveling body may be interrupted because the cable at the swiveling side is strongly pulled.

The present invention has been made in view of the above-mentioned problems, and the object is to provide a construction machine that can establish a more reliable electrical connection between an upper swiveling body thereof and a lower traveling body.

Means for Solving the Problems

According to one aspect of the present invention, a construction machine is provided with a lower traveling body, an upper swiveling body, and a rotary coupling member that swivels together with the upper swiveling body with respect to the lower traveling body. The rotary coupling member includes: a body having a through hole; a swivel joint having a shaft that is disposed at the through hole of the body to be rotatable with respect to the body and that is provided with a communication hole; a rotor element rotating together with the shaft; a stator element; a rotary joint including a slip ring that has a terminal part disposed in the stator element; a cable penetrating the communication hole of the shaft to be electrically connected to the terminal part of the rotor element; a coupling part coupled with at least one of the rotor element of the slip ring and the shaft; and a detent part that is fixed to the body and that restricts rotation of the terminal part of the slip ring.

Effect of the Invention

The present invention provides a more reliable electrical connection between the upper swiveling body and the lower traveling body.

DESCRIPTION OF EMBODIMENTS

Figure 1:
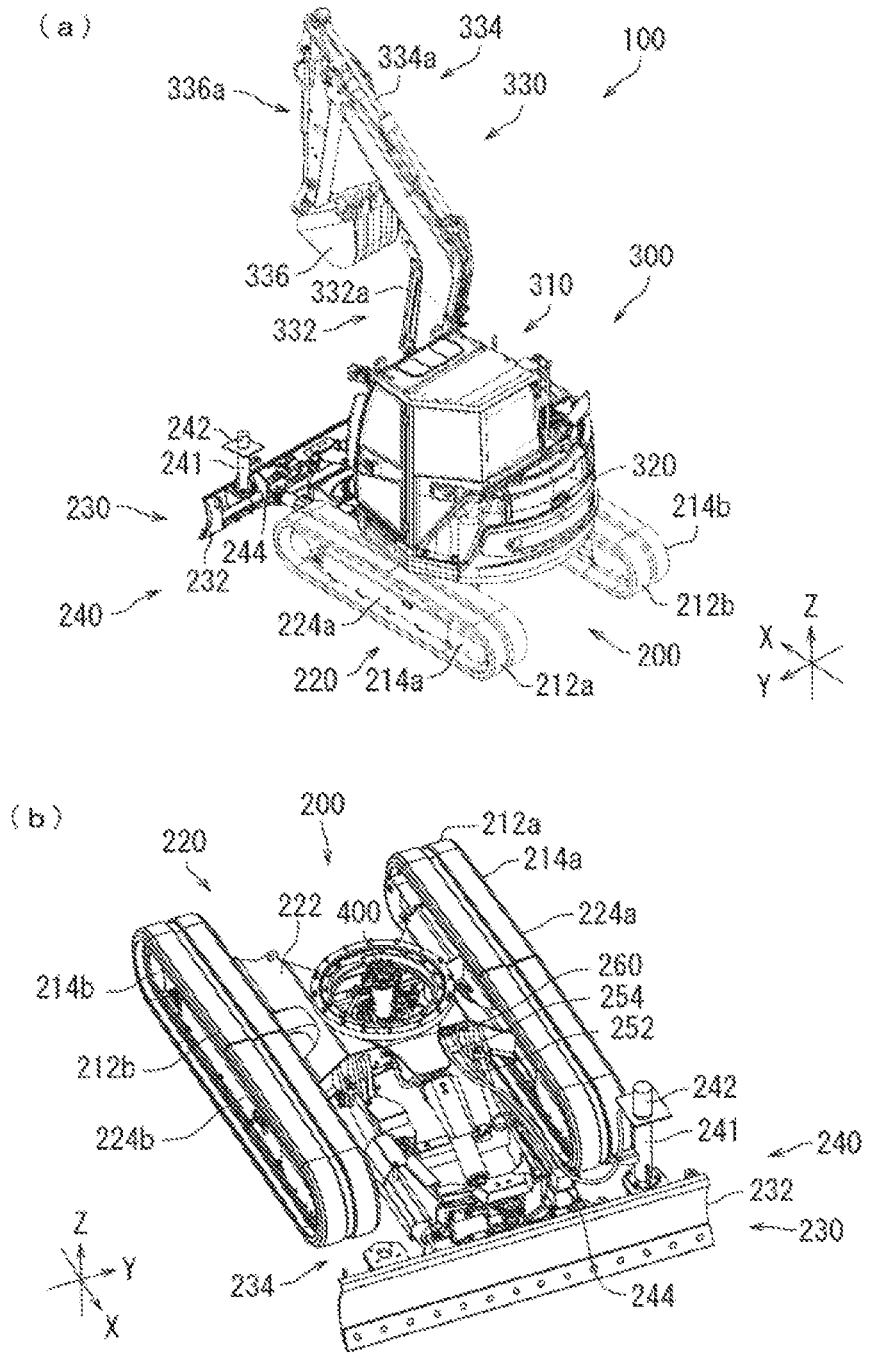
FIG. 1(*a*) is a schematic perspective view of a construction machine according to the present embodiments, and (*b*) is a schematic perspective view of a lower traveling body and a rotary coupling member in the construction machine.

The following will describe embodiments of a construction machine according to the present invention with reference to the drawings. It is noted that in the drawings, the same or corresponding portions are provided with the same reference characters and will not be repeatedly described. The specification of the present application may describe X, Y, and Z axes orthogonal to each other in order to facilitate understanding of the invention. Typically, the X axis indicates a traveling direction of the lower traveling body, the Z axis indicates a vertical direction of the lower traveling body, and the Y axis indicates a direction orthogonal to the traveling direction and the vertical direction of the lower traveling body. However, the X, Y and Z axes are not limited to the above.

First, a construction machine 100 according to the present embodiments will be described with reference to FIGS. 1(*a*) and 1(*b*). A hydraulic shovel is described as one example of the construction machine 100. However, the construction machine 100 may be, but not limited to a hydraulic shovel, an electric shovel. Alternatively, the construction machine 100 may be another construction machine.

FIG. 1(*a*) is a schematic perspective view of the construction machine 100 according to the present embodiments, and FIG. 1(*b*) is a schematic perspective view of a lower traveling body 200 and a rotary coupling member 400 in the construction machine 100 according to the present embodiments.

The construction machine 100 includes the lower traveling body 200, an upper swiveling body 300, and a rotary coupling member 400. The lower traveling body 200 is capable of self-traveling. The upper swiveling body 300 swivels together with the rotary coupling member 400 with respect to the lower traveling body 200.

The lower traveling body 200 includes a traveling mechanism 210, a truck frame 220, and an earth removal mechanism 230. The traveling mechanism 210 enables the construction machine 100 to travel.

The traveling mechanism 210 includes a pair of right and left crawlers 212*a* and 212*b*, and a pair of right and left electric motors 214*a* and 214*b* for traveling. The left and right electric motors 214*a* and 214*b* for traveling drive the left and right crawlers 212*a* and 212*b*, respectively, thereby enabling the construction machine 100 to move forward and backward.

The electric motors 214*a* and 214*b* for traveling are mounted on the truck frame 220. In addition, the rotary coupling member 400 is disposed on the truck frame 220.

The truck frame 220 includes a center frame 222 that is located at a middle part, and a pair of right and left side frames 224*a* and 224*b* that are disposed lateral to the center frame 222. The rotary coupling member 400 is mounted on a top surface of the center frame 222.

Further, the lower traveling body 200 is provided with the earth removal mechanism 230. The earth removal mechanism 230 is used to perform an earth removal operation for earth, sand, or the like and a ground leveling operation for a developed land, a road, or the like. The earth removal mechanism 230 has a blade 232 and a blade cylinder 234 for moving the blade 232 with respect to the lower traveling body 200. The blade cylinder 234 is, for example, a hydraulic cylinder. For example, the blade cylinder 234 includes a lift cylinder to rotate the blade 232 in a vertical direction.

The upper swiveling body 300 is provided with a steering unit 310, a controller 320, and a work machine 330. The steering unit 310 is disposed on an upper part of the rotary coupling member 400. A steering seat is placed in the steering unit 310. A pair of work operation levers are disposed to left and right sides of the steering seat, and a pair of traveling levers are disposed in front of the steering seat. An operator can sit on the steering seat and control each hydraulic actuator by operating the work operation levers, the traveling levers, and the like, thereby being capable of carrying out traveling, swiveling, work, or the like.

The controller 320 is disposed at a rear part of the steering unit 310. The controller 320 controls each component of the construction machine 100.

The work machine 330 is dispose in front of the steering unit 310. The work machine 330 includes a boom 332, an arm 334, and a bucket 336, and drives them independently, thereby being capable of performing an excavation operation for earth, sand or the like.

The boom 332 has a base end part supported at a front part of the upper swiveling body 300 so as to be rotated by a boom cylinder 332*a* which is telescopically movable. Alternatively, the arm 334 has a base end part supported at a leading end part of the boom 332 so as to be rotated by an arm cylinder 334*a* which is telescopically movable. The bucket 336 has a base end part supported at a leading end part of the arm 334 so as to be rotated by a bucket cylinder 336*a* which is telescopically movable. The boom cylinder 332*a*, the arm cylinder 334*a*, and the bucket cylinder 336*a* are composed of a hydraulic cylinder.

The upper swiveling body 300 can swivel with respect to the lower traveling body 200 via the rotary coupling member 400. The upper swiveling body 300 has a swivel motor, a motor, a power supply unit, and the like (not illustrated) disposed therein in addition to the steering unit 310 and the controller 320. The upper swiveling body 300 swivels via the rotary coupling member 400 by means of a driving force of the swivel motor. In addition, there are disposed on the upper swiveling body 300 a plurality of hydraulic pumps that are driven by a motor. These hydraulic pumps supply oil pressure to each hydraulic actuator (the blade cylinder 234, the boom cylinder 332*a*, the arm cylinder 334*a*, the bucket cylinder 336*a*, the swivel motor, or the like). Besides, the power supply unit may be disposed at the lower traveling body 200.

The upper swiveling body 300 has a power supply port (not illustrated) provided therein, and a power supply cable of a commercial power supply (corresponding to an external power supply) is connected to this power supply port, so that the commercial power supply can be connected to the power supply unit.

Thus, the construction machine 100 according to the present embodiments is provided with the earth removal mechanism 230 along with the work machine 330.

As illustrated in FIG. 1(*b*), the center frame 222 is disposed between the crawler 212*a* and the crawler 212*b*. The center frame 222A has the rotary coupling member 400 disposed thereon. The rotary coupling member 400 is disposed at the middle of the center frame 222.

In a case where the upper swiveling body 300 swivels with respect to the lower traveling body 200, the rotary coupling member 400 swivels together with the upper swiveling body 300. Therefore, in a case where the upper swiveling body 300 swivels with respect to the lower traveling body 200, the rotary coupling member 400 becomes a swivel axis of the upper swiveling body 300. The rotary coupling member 400 is also used as an oil channel between the upper swiveling body 300 and the lower traveling body 200.

The earth removal mechanism 230 is mounted on the lower traveling body 200. The lower traveling body 200 is provided with a detection device 240. The detection device 240 is used to detect at least one of a posture and a position of the blade 232.

The detection device 240 includes a prism 242 and an angle sensor 244. The prism 242 functions as a target for a total station. The prism 242 is disposed at an upper part of a pillar 241 which is installed on the blade 232.

The angle sensor 244 detects an angle of the blade 232. The angle sensor 244 is installed at a back side of the blade 232.

The lower traveling body 200 further has a relay member 260. The relay member 260 functions as a so-called connector. The prism 242 is electrically connected to the relay member 260 via a cable 252. In addition, the angle sensor 244 is electrically connected to the relay member 260 via the cable 254. The relay member 260 is electrically connected to the rotary coupling member 400. As described below, the relay member 260 is electrically connected to an end part of the rotary coupling member 400.

Figure 2:
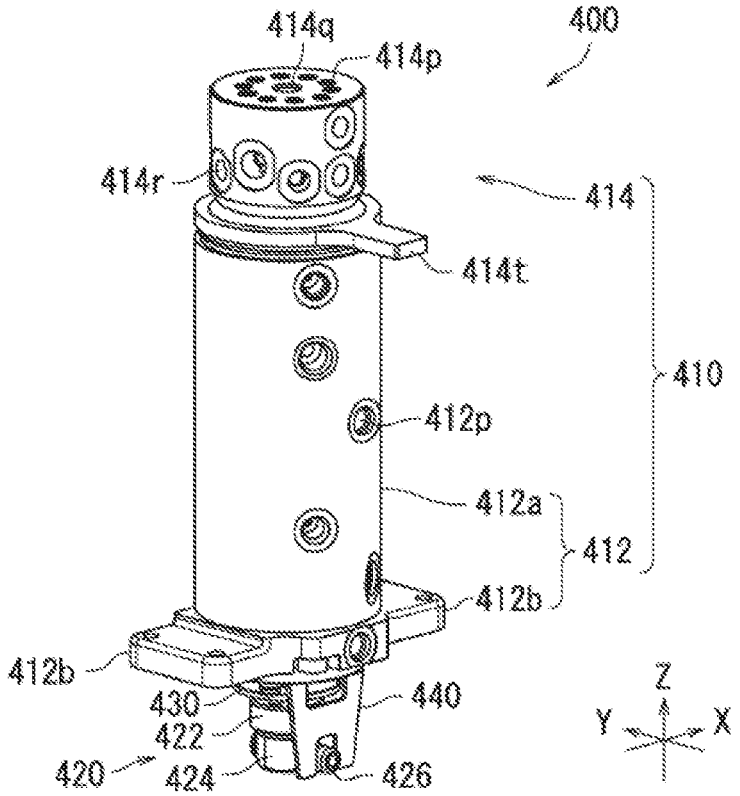
FIG. 2(*a*) is a schematic perspective view of the rotary coupling member in the construction machine according to the present embodiments, and (*b*) is a schematic top view of the rotary coupling member.
Figure 2:
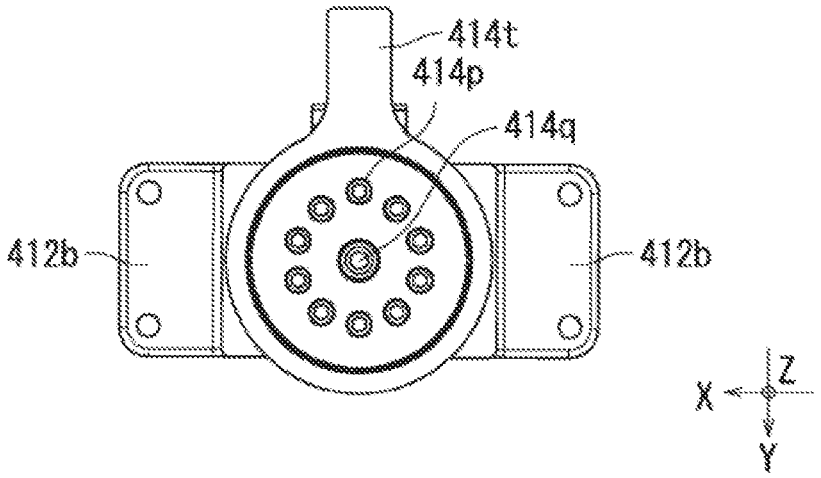

Next, referring to FIG. 2, the rotary coupling member 400 in the construction machine 100 according to the present embodiments is described. FIG. 2(*a*) is a schematic perspective view of the rotary coupling member 400, and FIG. 2(*b*) is a schematic top view of the rotary coupling member 400.

As is illustrated in FIGS. 2(*a*) and 2(*b*), the rotary coupling member 400 has a swivel joint 410, a rotary joint 420, a coupling part 430, and a detent part 440. The swivel joint 410 extends in a vertical direction. Here, the rotary joint 420 is attached to a lower end of the swivel joint 410. The rotary joint 420 includes a slip ring. The rotary joint 420 may, however, include a contactless power feeding device.

The coupling part 430 is coupled with at least one of the swivel joint 410 and the rotary joint 420. The coupling part 430 fixes the rotary joint 420 to the swivel joint 410.

The swivel joint 410 includes a body 412 and a shaft 414. The body 412 has a substantially cylindrical shape. The shaft 414 is rotatably inserted into a through hole of the body 412. The shaft 414 is rotatable with respect to the body 412. The shaft 414 inserted into the body 412 can rotate around a central axis parallel to a Z axis. The body 412 is fixed to the lower traveling body 200 (FIG. 1). The shaft 414 rotates with respect to the body 412 together with swiveling of the upper swiveling body 300.

There are provided at the shaft 414 a vertical hole 414*p* and a communication hole 414*q*. The vertical hole 414*p* and the communication hole 414*q* extend in a Z axis direction. The vertical holes 414*p* are arranged substantially uniformly on a circumference at a predetermined distance from the central axis of the shaft 414. The vertical holes 414*p* function as an oil channel. The communication hole 414*q* is disposed at the central axis of the shaft 414 and in a vicinity thereof. The communication hole 414*q* function as a wiring path. For example, a cable for signal transmission or power supply inserted into the communication hole 414*q*.

A portion of the shaft 414 is inserted into the through hole of the body 412 while another portion of the shaft 414 protrudes from the body 412. There is a detent part 414*t* provided at a portion of the shaft 414 which protrudes from the body 412. The detent part 414*t* protrudes radially outward from the shaft 414. The detent part 414*t* is engaged with the upper swiveling body 300. This causes the shaft 414 to rotates together with the swiveling of the upper swiveling body 300 (FIG. 1(*a*)).

The rotary joint 420 preferably includes a slip ring. In this case, the rotary joint 420 has a rotor element 422, a stator element 424, and a terminal part 426. The rotor element 422 is rotatable with respect to the stator element 424. The rotor element 422 has a rotatable ring part and a brush part sliding around the ring part mounted therein. In the rotor element 422, a wiring extending from the ring part is electrically connected to a wiring extending from the brush part. The ring part is integrated with a shaft part and rotates within a case part that houses the brush part. For example, the rotor element 422 includes the ring part and the shaft part, and the stator element 424 includes the case part. The ring part is electrically connected to a cable disposed in the communication hole 414*q* of the shaft 414. The terminal part 426 is provided at the stator element 424. For example, the terminal part 426 and the stator element 424 are integrally formed.

The coupling part 430 are coupled with at least one of the shaft 414 of the swivel joint 410 and the rotor element 422 of the rotary joint 420. Here, the coupling part 430 is disposed between the swivel joint 410 and the rotor element 422 of the rotary joint 420, and couples the shaft 414 of the swivel joint 410 with the rotor element 422 of the rotary joint 420. The coupling part 430 rotates together with the shaft 414 with respect to the body 412.

The detent part 440 is attached to the swivel joint 410. The detent part 440 restricts rotation of the rotary joint 420.

The body 412 has a substantially cylindrical shape extending in a vertical direction. The body 412 has a main body part 412*a* and a fixing part 412*b*. The main body part 412*a* has an oil channel that connects the upper swiveling body 300 to the lower traveling body 200.

The fixing part 412*b* is located at a lower part of the main body part 412*a*. The fixing part 412*b* is fixed to the lower traveling body 200 (FIG. 1). The main body part 412*a* is fixed to the lower traveling body 200 by the fixing part 412*b*. The fixing part 412*b* extends in a X direction with respect to the main body part 412*a*. The fixing part 412*b* allows the swivel joint 410 to be easily fixed to the lower traveling body 200.

The fixing part 412*b* may be formed integrally with the main body part 412*a*. For example, the fixing part 412*b* may be welded to the main body part 412*a*. Alternatively, the fixing part 412*b* may be formed of a member different from the main body part 412*a*.

The detent part 440 is attached to the body 412 of the swivel joint 410. For example, the detent part 440 is attached to the fixing part 412*b* of the swivel joint 410. The detent part 440 restricts rotation of the rotary joint 420. In detail, the detent part 440 restricts rotation of the terminal part 426 along with rotation of the rotor element 422 of the rotary joint 420.

For example, the detent part 440 may come into contact with the terminal part 426 to restrict the rotation of the terminal part 426. Alternatively, the detent part 440 may come into contact with the stator element 424 to restrict rotation of the stator element 424, thereby restricting the rotation of the terminal part 426.

The rotary joint 420 is attached to a lower part of the swivel joint 410. In this case, a shaft part of the rotary joint 420 is fixed to the shaft 414, and a case part of the rotary joint 420 is engaged with the detent part 440 that is erected from the body 412 so as to attach and fix the terminal part 426 that protrudes from a side wall of the case part (stator element 424).

It is noted that the rotary joint 420 may be mounted on an upper part of the swivel joint 410. In this case, preferably, the case part (stator element 424) of the rotary joint 420 is coupled with the shaft 414 so as to attach and fix a shaft part (rotor element 422) by the detent part 440 attached to the body 412.

The coupling part 430 may be a member different from the swivel joint 410 and the rotary joint 420. For example, the coupling part 430 may be a space seat or a spacer.

Alternatively, the coupling part 430 may be integrally formed with the swivel joint 410 or the rotary joint 420, and the coupling part 430 may be a single member with one of the swivel joint 410 and the rotary joint 420. For example, the coupling part 430 may be formed integrally with the swivel joint 410. For example, the coupling part 430 may be welded to the swivel joint 410, or may be adhered to the swivel joint 410 with an adhesive. Alternatively, the coupling part 430 may be welded to the rotary joint 420, or may be adhered to the rotary joint 420 with an adhesive.

The detent part 440 is attached to a portion other than the shaft 414 of the swivel joint 410. For example, the detent part 440 is attached to the fixing part 412*b*. A construction machine 100 according to the present embodiments can efficiently attach a rotary joint 420 to the lower end of the swivel joint 410. This can make it easy to collect information from the detection device 240 (FIG. 1) attached to the lower traveling body 200 and/or to supply power to electric equipment attached to the lower traveling body 200 even in a case where the construction machine 100 is relatively small.

Figure 3:
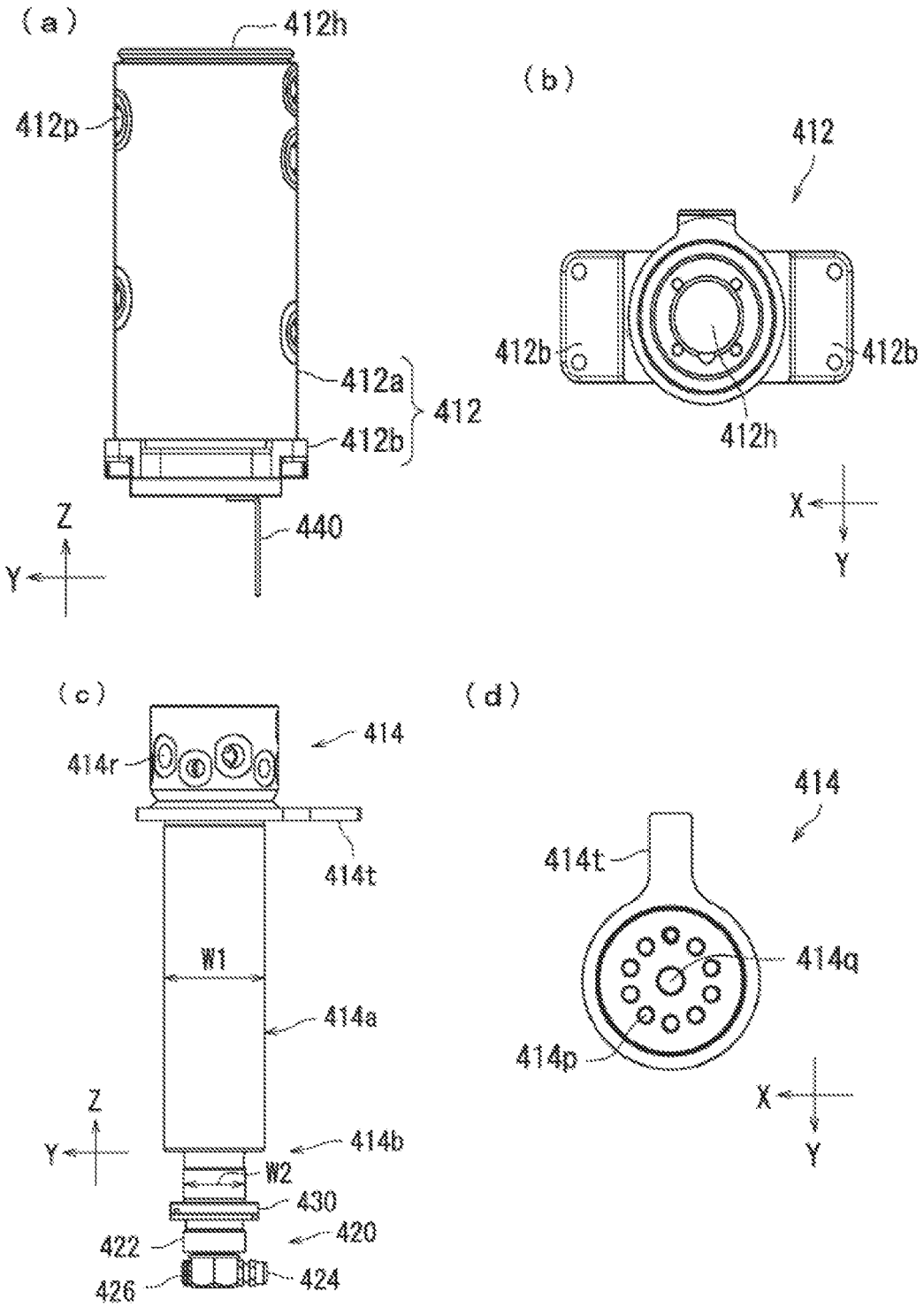
FIG. 3(*a*) is a schematic side view of a body and a detent part of the rotary coupling member in the construction machine according to the present embodiments, (*b*) is a schematic top view of the body, (*c*) is a schematic side view of a shaft, a rotary joint and a coupling part of the rotary coupling member, and (*d*) is a schematic top view of the shaft of the rotary coupling member.

Next, the rotary coupling member 400 in the construction machine 100 according to the present embodiments will be described in detail with reference to from FIGS. 1 to 3. FIG. 3(*a*) is a schematic side view of the body 412 and detent part 440 of the rotary coupling member 400, and FIG. 3(*b*) is a schematic top view of the body 412.

As is illustrated in FIGS. 3(*a*) and 3(*b*), the body 412 of the swivel joint 410 has a cylindrical shape. The body 412 is provided with a through hole 412*h*. The through hole 412*h* extends in a vertical direction. The shaft 414 is inserted into the through hole 412*h*.

In addition, the body 412 is provided with a horizontal hole 412*p*. The horizontal hole 412*p* extends in a horizontal direction. The horizontal hole 412*p* allows the inside of body 412 to communicate with the outside thereof. A plurality of horizontal holes 412*p* are provided at a side part of the body 412. The horizontal hole 412*p* are used as an oil channel.

The detent part 440 is attached to the fixing part 412*b* of the body 412. The detent part 440 is attached to the fixing part 412*b* of the body 412 and extends vertically downward from the fixing part 412*b*.

FIG. 3(*c*) is a schematic side view of the shaft 414, rotary joint 420 and coupling part 430 of the rotary coupling member 400, and FIG. 3(*d*) is a schematic top view of the shaft 414.

As illustrated in FIGS. 3(*c*) and 3(*d*), the shaft 414 has a substantially columnar shape. The shaft 414 is provided with a plurality of holes.

A vertical hole 414*p* is provided at the shaft 414. The vertical hole 414*p* extends in a vertical direction. In detail, the shaft 414 is provided with a plurality of vertical holes 414*p* that are equally spaced at positions away from the central axis. The vertical hole 414*p* is used as an oil channel. The vertical hole 414*p* has a columnar shape. Typically, individual diameters of the plurality of the vertical holes 414*p* are equal to each other.

The shaft 414 is also provided with a central axis and the communication hole 414*q* around the central axis. According to the present embodiment, a cable is disposed in the communication holes 414*q*. The communication hole 414*q* has a columnar shape. It is noted that here, a diameter (for example, length in a X direction) of the communication hole 414*q* is larger than a diameter (for example, length in a X direction) of the vertical hole 414*p*.

In addition, there is provided above the shaft 414 in a vertical direction a horizontal hole 414*r* that is coupled with an oil channel at a side of the upper swiveling body 300.

It is noted that the shaft 414 is inserted into the through holes provided at the main body part 412*a* and fixing part 412*b* of the body 412. Shaft 414 has a main part 414*a* corresponding to the main body part 412*a* and a leading end part 414*b* corresponding to the fixing part 412*b*. A diameter (W2) of the leading end part 414*b* is smaller than a diameter (W1) of the main part 414*a*.

It is noted that although omitted in FIG. 3(*c*) to simplify the drawing, an o-ring, which forms an oil channel corresponding to an actuator installed in the lower traveling body 200, is sealed at a middle part in a vertical direction of the shaft 414.

Figure 4:
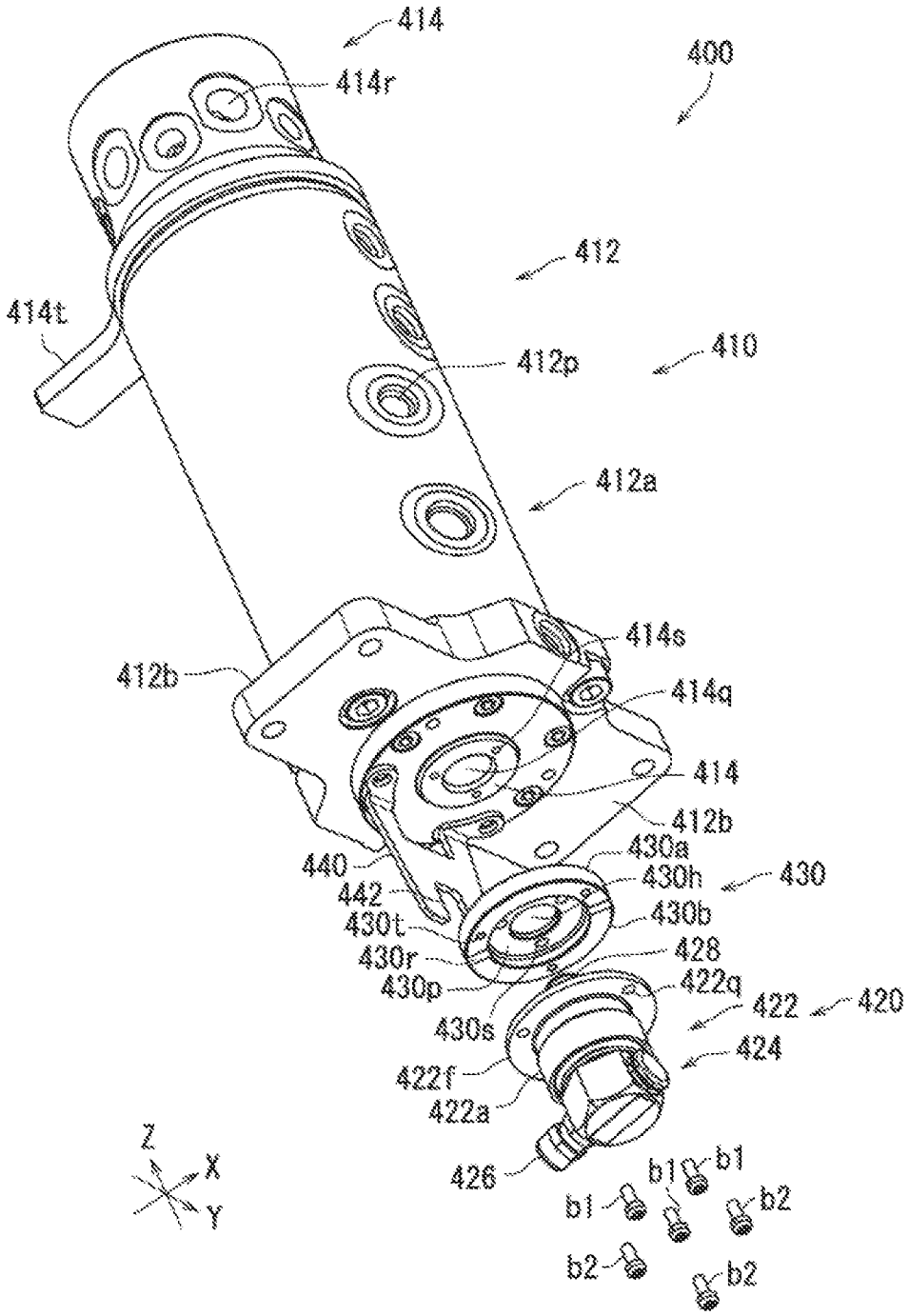
FIG. 4 is a schematic exploded perspective view of the rotary coupling member in the construction machine according to the present embodiments.

Next, the rotary coupling member 400 in the construction machine 100 according to the present embodiments will be described with reference to FIGS. 1 to 4. FIG. 4 is an exploded perspective view of the rotary coupling member 400 in the construction machine 100.

As is illustrated in FIG. 4, the rotary joint 420 is attached to a lower part of the swivel joint 410 via the coupling part 430. In detail, the coupling part 430 couples the shaft 414 to the rotary joint 420 at the lower part of the swivel joint 410.

The detent part 440 is attached to the body 412 of the swivel joint 410.

The rotary joint 420 electrically connects a cable that penetrates the communication hole 414*q* of the swivel joint 410 to a cable that is connected to the terminal part 426 of the rotary coupling member 400. The rotary joint 420 has the rotor element 422, the stator element 424, and the terminal part 426. There is disposed inside the rotor element 422 a terminal part 428 that is electrically connected to the terminal part 426. The terminal part 428 is electrically connected to the cable that penetrates the communication hole 414*q* of the swivel joint 410.

The rotor element 422 has a main part 422*a* and a flange part 422*f*. The main part 422*a* and the flange part 422*f* are integrally formed. Outer shapes of the main part 422*a* and flange 422*f* respectively are cylindrical. The flange part 422*f* is located at an upper outer edge of the rotor element 422. A diameter of the flange part 422*f* is larger than a diameter of the main part 422*a*. A bolt hole 422*q* is provided at the flange part 422*f*

As is described above, the flange part 422*f* is located at the upper outer edge of the rotor element 422. An outer edge of the coupling part 430 is substantially equal to an outer edge of the flange part 422*f*. Therefore, the coupling part 430 is firmly fixed to the flange part 422*f* of the rotary joint 420.

The coupling part 430 may be a space seat. In this case, the coupling part 430 functions as an adapter between the swivel joint 410 and the rotary joint 420. The coupling part 430 has a thin disc shape, and a through hole 430*h* is provided at a center of the coupling part 430.

The coupling part 430 has a thin plate shape. The coupling part 430 has a main surface 430*a* and a main surface 430*b*. The main surface 430*a* of the coupling part 430 is opposed to the swivel joint 410, and the main surface 430*b* of the coupling part 430 is opposed to the rotary joint 420. The through hole 430*h* of the coupling part 430 penetrates the main surfaces 430*a* and 430*b* of the coupling part 430.

The main surface 430*b* is provided with a recess 430*p* in communication with the through hole 430*h*. An outer diameter of the recess 430*p* is smaller than an outer diameter of the flange 424*f* of the rotary joint 420. The coupling part 430 is provided with a bolt hole 430*s* that penetrates the recess 430*p* in a vertical direction and a bolt hole 430*t* that extends in a vertical direction outside the recess 430*p*. The bolt hole 430*s* is provided at a bottom surface of the recess 430*p* of the coupling part 430, and the bolt hole 430*t* is provided outside the recess 430*p* of the coupling part 430.

There is provided at the shaft 414 of the swivel joint 410 a bolt hole 414*s*, which is threaded, so as to correspond to the bolt hole 430*s* of the coupling part 430. Bolt b1 is inserted into the bolt hole 430*s* and 414*s*, so that the coupling part 430 is fixed to the shaft 414 of the swivel joint 410.

The bolt hole 430*t* is also threaded. Bolt b2 is inserted into the bolt hole 422*q* and 430*t* of the rotary joint 420, so that the rotary joint 420 is fixed to the coupling part 430. As is described above, irrespective of a size of the shaft 414 of the swivel joint 410, the coupling part 430 allows the existing rotary joint 420 to be attached to the shaft 414 as a rotary joint 420.

In addition, a communicating hole 430*r* is provided at the main surface 430*b* of the coupling part 430. The communicating hole 430*r* communicates the recess 430*p* of the coupling part 430 with the outside.

The detent part 440 is provided with an engagement part 442. The detent part 440 is recessed from a vertical lower side to a vertical upper side in the engagement part 442. The engagement part 442 engages the terminal part 426 of the rotary joint 420. A diameter of the engagement part 442 is almost equal to or slightly larger than a diameter of the terminal part 426. As is described above, since the engagement part 442 of the detent part 440 is engaged with the terminal part 426 of the rotary joint 420, the stator element 424 and the terminal part 426 can be prevented from rotating together with the rotor element 422 even in a case where the rotator 422 of the rotary joint 420 rotates.

Figure 5:
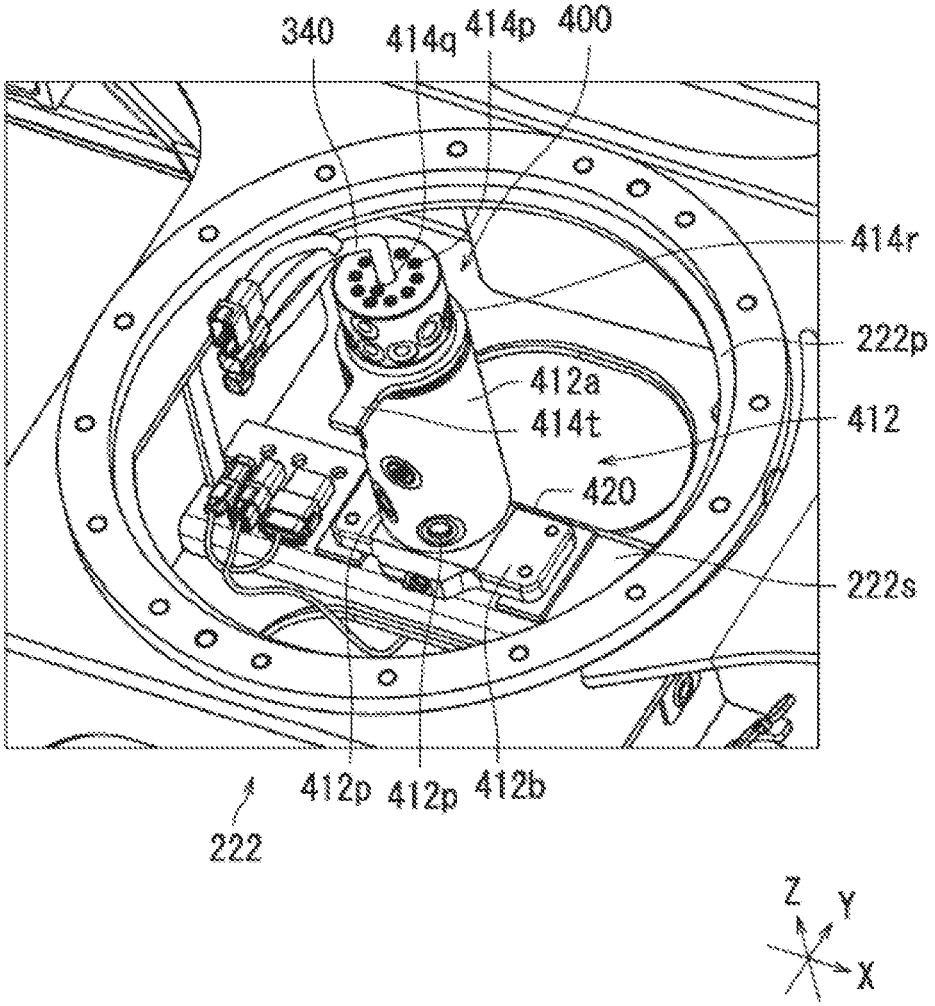
FIG. 5 is a schematic partial enlarged view of the construction machine according to the present embodiments.

Next, the rotary coupling member 400 in the construction machine 100 according to the present embodiments will be described with reference to FIGS. 1 to 5. FIG. 5 is a schematic perspective view in a vicinity of the rotary coupling member 400 in the construction machine 100.

The rotary coupling member 400 is disposed on an upper part of the center frame 222 of the lower traveling body 200. In detail, a circular-shaped through hole 222*p* is provided at a middle part of the center frame 222, and there is provided a support part 222*s* that extends in a X direction so as to cover a portion of the through hole 222*p*. The rotary coupling member 400 is supported by the support part 222*s* of the center frame 222.

As is described above, the rotary joint 420 is attached to the lower end of the swivel joint 410. A typical relatively small construction machine has various kinds of pipes and/or cables disposed at the upper part of the swivel joint 410, so that there is no spatial margin at the upper part of the swivel joint 410 has. On the other hand, there are fewer pipes and/or cables disposed at the lower part of the swivel joint 410, so that the swivel joint 410 is likely to have more spatial margin available at the lower part thereof. For this reason, it is preferable that the rotary joint 420 would be attached to the lower end of the swivel joint 410. However, the rotary joint 420 may be attached to the upper end of the swivel joint 410.

The construction machine 100 according to the present embodiments enables the rotary joint 420 to be attached to a swivel axis center of the construction machine 100. Therefore, it is not necessary to arrange cables capable of collecting information from the detection device 240 (FIG. 1) attached to the lower traveling body 200 and/or supplying power to electric equipment attached to the lower traveling body 200, which results in that the construction machine 100 can swivel relatively freely.

The shaft 414 can rotate together with the upper swiveling body 300 with respect to the lower traveling body 200, while the body 412 is fixed to the lower traveling body 200.

Furthermore, as is illustrated in FIGS. 3(*c*) and 3(*d*), the shaft 414 is provided with the vertical hole 414*p* that has a circumferential shape and extends in a vertical direction. There is provided above the shaft 414 in a vertical direction the horizontal hole 414*r* that is coupled with an oil channel at a side of the upper swiveling body 300, and the vertical hole 414*p* in communication with the horizontal hole 414*r*. The vertical hole 414*p* of the shaft 414 and the horizontal hole 412*p* of the main body part 412*a* form an oil channel at a side of the lower traveling body 200.

It is noted that there are formed at the shaft 414 from upward to downward a plurality of oil channels that are scribed and provided circumferentially for each actuator installed in the lower traveling body 200, and the above and below oil channels are sealed by an o-ring therebetween.

The shaft 414 is provided with the communication hole 414*q* that extends in a vertical direction. A cable 340 is inserted into the communication hole 414*q*. The cable 340 inserted into the communication hole 414*q* is electrically connected to the controller 320 (FIG. 1(*a*)) of the upper swiveling body 300. The cable 340 may be a cable arranged in the upper swiveling body 300, or may be a cable dedicated to the rotary coupling member 400.

The fixing part 412*b* located at a lower part of the body 412 is fastened by a bolt to and fixed on a bottom surface of the truck frame 220 of the lower traveling body 200. A tip of the shaft 414 penetrates the fixing part 412*b* from the main body part 412*a* with its diameter smaller than a diameter of the shaft 414 which is fit into the main body part 412*a*. There is provided at a central part of the shaft 414 the communication hole 414*q* that penetrates the upper end part and lower end part of the shaft 414, and the cable 340 that extends from the rotary joint 420 is caused to pass through the communication hole 414*q*. In addition, the shaft 414 swivels integrally with the upper swiveling body 300 by means of the detent part 414*t* attached to the upper swiveling body 300.

Figure 6:
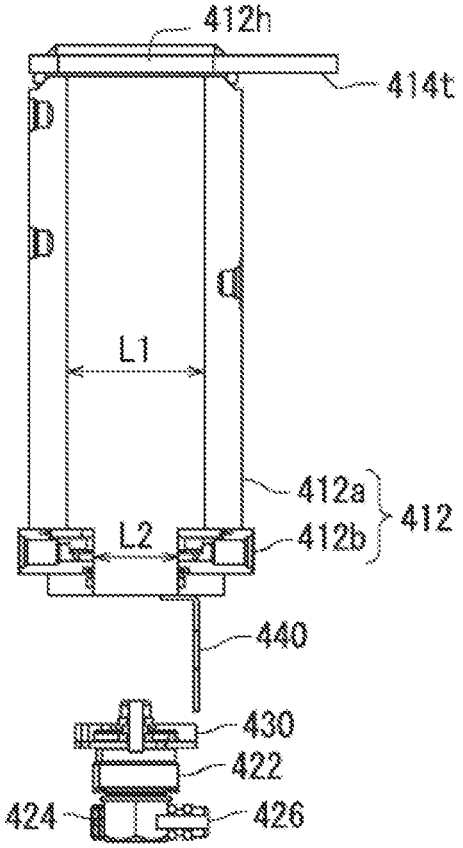
FIG. 6 (*a*) is a schematic sectional view of the rotary coupling member without the shaft in the construction machine according to the present embodiments, and (*b*) is a schematic partial enlarged view of the rotary coupling member.
Figure 6:
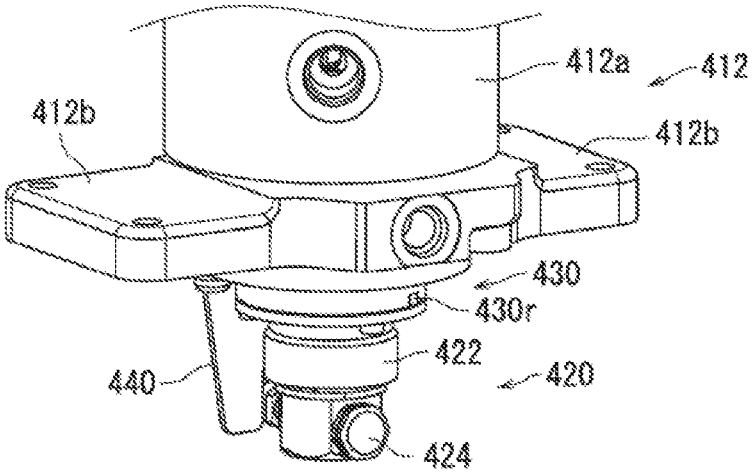

Next, the rotary coupling member 400 in the construction machine 100 according to the present embodiments will be described with reference to FIGS. 1 to 6. FIG. 6(*a*) is a schematic sectional view of the rotary coupling member 400 in which the shaft 414 is removed and the coupling part 430 is separated from the body 412 in the construction machine 100.

As is illustrated in FIG. 3(*c*) and FIG. 6(*a*), the body 412 is provided with the through hole 412*h* into which the shaft 414 is inserted. The shaft 414 penetrates the through hole of the body 412 and that of the fixing part 412*b*. As is described above, a diameter (W2) of the leading end part of shaft 414*b* is smaller than a diameter (W1) of the main part 414*a* of the shaft 414. A diameter of the through hole 412*h* varies in accordance with a position in a vertical direction. In the through hole 412*h*, a diameter (L2) of a portion corresponding to the fixing part 412*b* is smaller than a diameter (L1) of a portion corresponding to the main body part 412*a*. This enables the shaft 414 to be easily inserted into the body 412 as well as enables oil to be prevented from leaking from the shaft 414.

In addition, the rotary joint 420 can be efficiently attached to the lower end of the swivel joint 410 of the construction machine 100. This can make it easy to collect information from the detection device 240 attached to the lower traveling body 200 and/or to supply power to electric equipment attached to the lower traveling body 200 even in a case where the construction machine 100 is small.

As is described above, the coupling part 430 is provided with a communicating hole 430*r*. The communicating hole 430*r* allows the inside of the coupling part 430 to communicate with the outside thereof.

FIG. 6(*b*) is a partial enlarged view of the rotary coupling member 400 in the construction machine 100. As is illustrated in FIG. 6(*b*), the coupling part 430 is provided with the communicating hole 430*r*. The communicating hole 430*r* is provided at a side part of the coupling part 430, and the communicating hole 430*r* allows the inside of the coupling part 430 to communicate with the outside thereof.

Even in a case where liquid such as rain water intrudes the inside of the rotary coupling member 400 through the communicating hole 430*r*, breakage of the rotary joint 420 can be suppressed. Since in particular, the construction machine 100 gets significantly soiled during work and is, therefore, often cleaned with a high pressure cleaning liquid, the liquid is likely to intrude into the inside of the rotary coupling member 400. However, even in a case where the liquid intrudes into the inside of the rotary coupling member 400, the communicating hole 430*r* of the coupling part 430 allows the intruded liquid to be discharged outside the rotary coupling member 400.

As is described above with reference to FIG. 1(*b*), the earth removal mechanism 230 is mounted on the lower traveling body 200, and a position and/or a posture of the earth removal mechanism 230 can be detected with a detection device 240.

Figure 7:
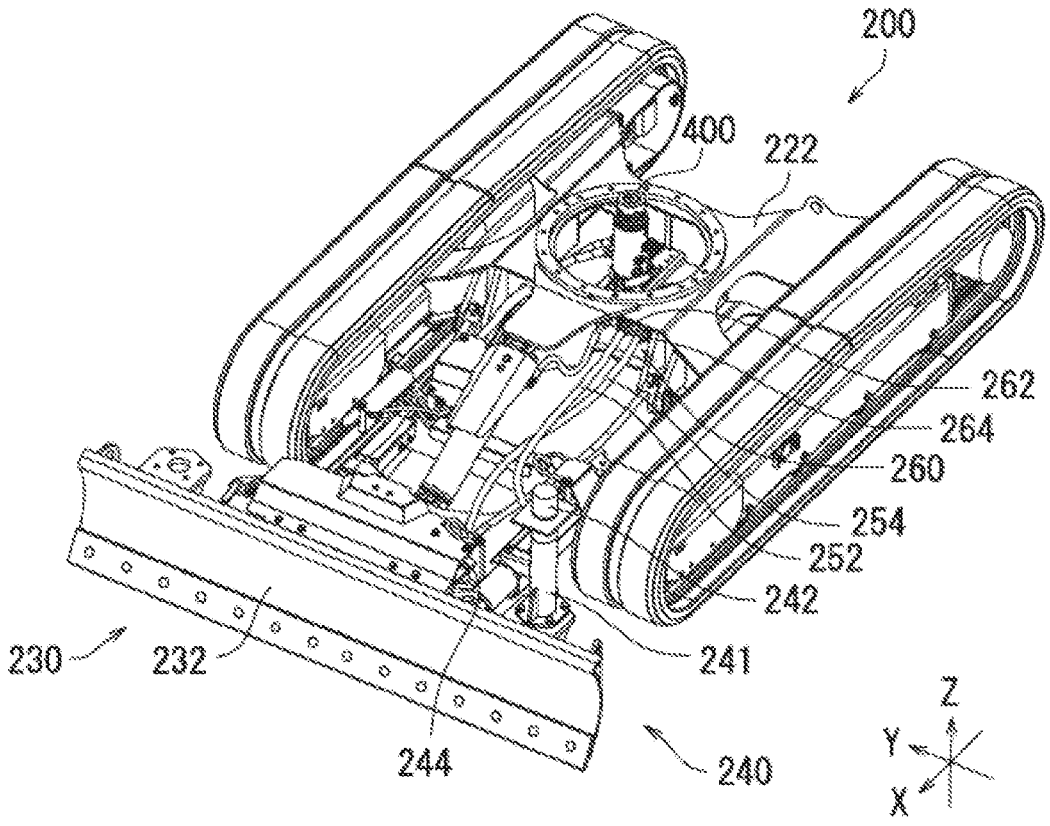
FIG. 7 is a schematic perspective view of the lower traveling body and the rotary coupling member in the construction machine according to the present embodiments.

Next, the construction machine 100 according to the present embodiments will be described with reference to FIG. 7. FIG. 7 is a schematic perspective view of the lower traveling body 200 and the rotary coupling member 400 in the construction machine 100.

The lower traveling body 200 has the earth removal mechanism 230 mounted thereon. The lower traveling body 200 is provided with the detection device 240 for detecting a posture and/or a position of the blade 232. The detection device 240 is connected to a cable extending from the center frame 222 of the lower traveling body 200.

The detection device 240 includes the prism 242 and the angle sensor 244. The prism 242 functions as a target for a total station. The prism 242 is mounted on the pillar 241 which is located at a back surface of the blade 232. The pillar 241 extends in a vertical direction. In detail, the 241 pillar is erected on a stay mounted on the back surface of the blade 232. The angle sensor 244 is mounted on a back side of the blade 232.

The relay member 260 is disposed at a front side of the center frame 222. The relay member 260 is electrically connected to the prism 242 via the cable 252 outside a housing of the center frame 222. The relay member 260 is also electrically connected to the angle sensor 244 via the cable 254. Thus, the detection device 240 is electrically connected to the rotary coupling member 400.

The relay member 260 has a first connector 262 and a second connector 264. The first connector 262 is coupled with the cable 252. The second connector 264 is coupled with the cable 254. The first connector 262 and the second connector 264 are respectively electrically connected to a terminal of the rotary coupling member 400.

Figure 8:
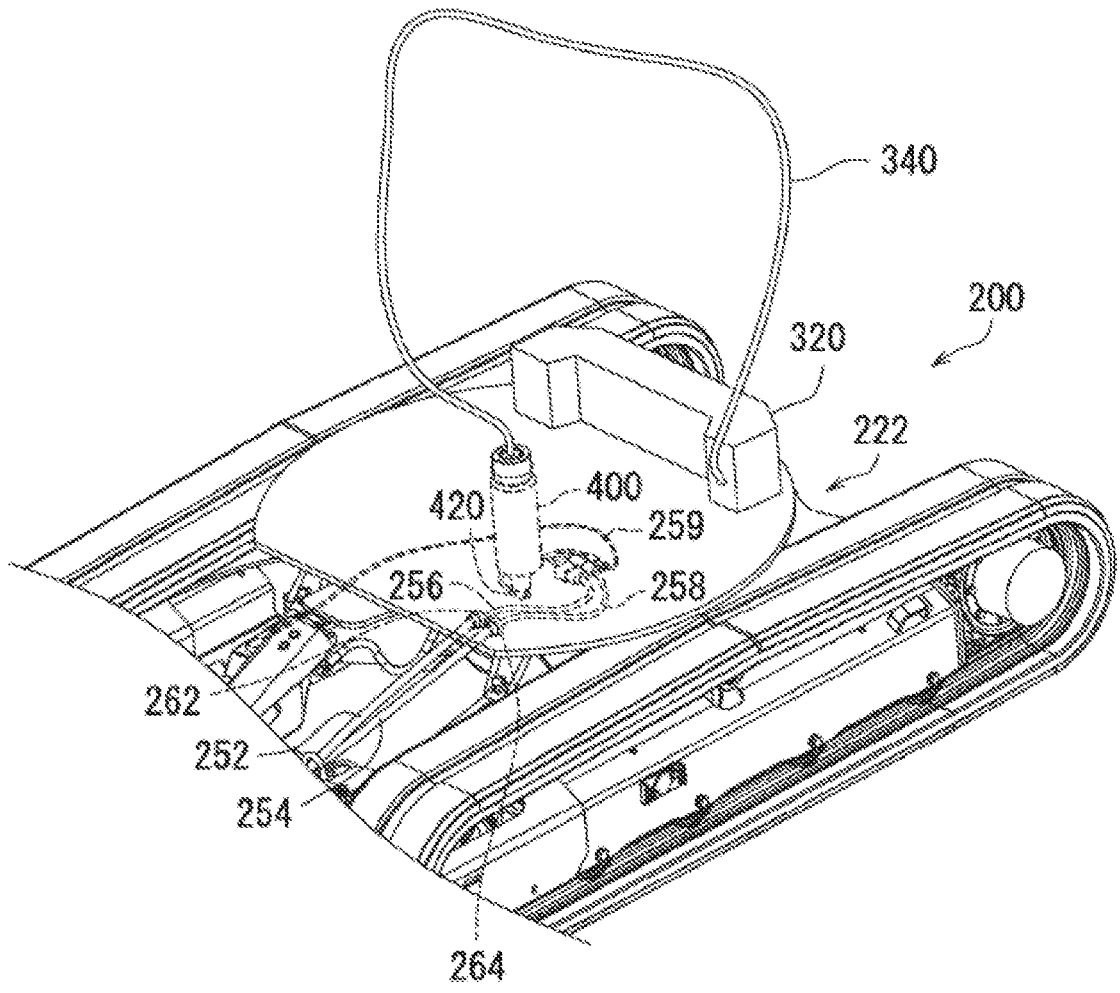
FIG. 8 is a schematic view of the lower traveling body and the rotary coupling member in the construction machine according to the present embodiments.

Next, the construction machine 100 according to the present embodiments will be described with reference to FIGS. 1 to 8. FIG. 8 is a schematic partial enlarged view illustrating electrical connections in the construction machine 100.

As is illustrated in FIGS. 7 and 8, the first connector 262 is electrically connected to a terminal part of the rotary joint 420 via the cable 256 inside the housing of the center frame 222. In addition, the second connector 264 is electrically connected to a terminal part of the rotary joint 420 via the cable 258. This causes the relay member 260 to be electrically connected to the terminal part of the rotary joint 420 of the rotary coupling member 400 via the cables 256 and 258. The terminal part of the rotary joint 420 is electrically connected to the controller 320 via the cable 340. For this purpose, the prism 242 and the angle sensor 244 are electrically connected to the controller 320 via the cables 252, 254, 256 and 258.

Thus, the rotary coupling member 400 not only rotates around the swivel axis, but also transmits power or electrical signals between the cables 252, 254, 256, 258 that extend from the detection device 240 and are disposed at the lower traveling body 200 and the cable 340 that is disposed inside the upper swiveling body 300. This can prevent the cables 252 and 254 extending from the detection device 240 from being damaged due to swiveling operation performed by the upper swiveling body 300.

It is noted that the cables 256 and 258 extend from the terminal part of the rotary joint 420 to the first connector 262 and the second connector 264 located at a left front of the construction machine 100. However, a cable 259 extending to a right front of the construction machine 100 may be connected to the terminal part of the rotary joint 420.

Figure 9:
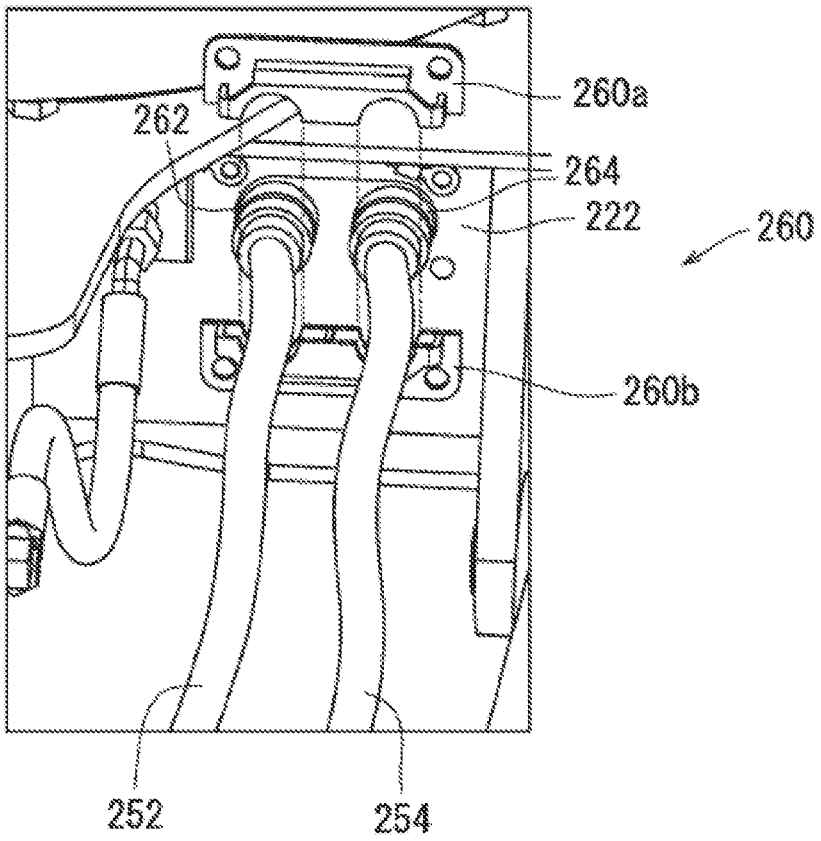
FIG. 9 is a partial enlarged view illustrating a vicinity of a relay member in the construction machine according to the present embodiments.

Next, the relay member 260 of the construction machine 100 according to the present embodiments will be described with reference to FIG. 9. FIG. 9 is a schematic partial enlarged view illustrating the relay member 260 and a vicinity thereof As is illustrated in FIG. 9, the relay member 260 is located in front of the center frame 222. The relay member 260 is sandwiched between a pair of upper and lower covers 260*a* and 260*b* which are notched so as to fit in sectional shapes of the first connector 262 and second connector 264, and then the covers 260*a* and 260*b* are bolted to the center frame 222, so that the relay member 260 is mounted in front of the center frame 222.

Figure 10:
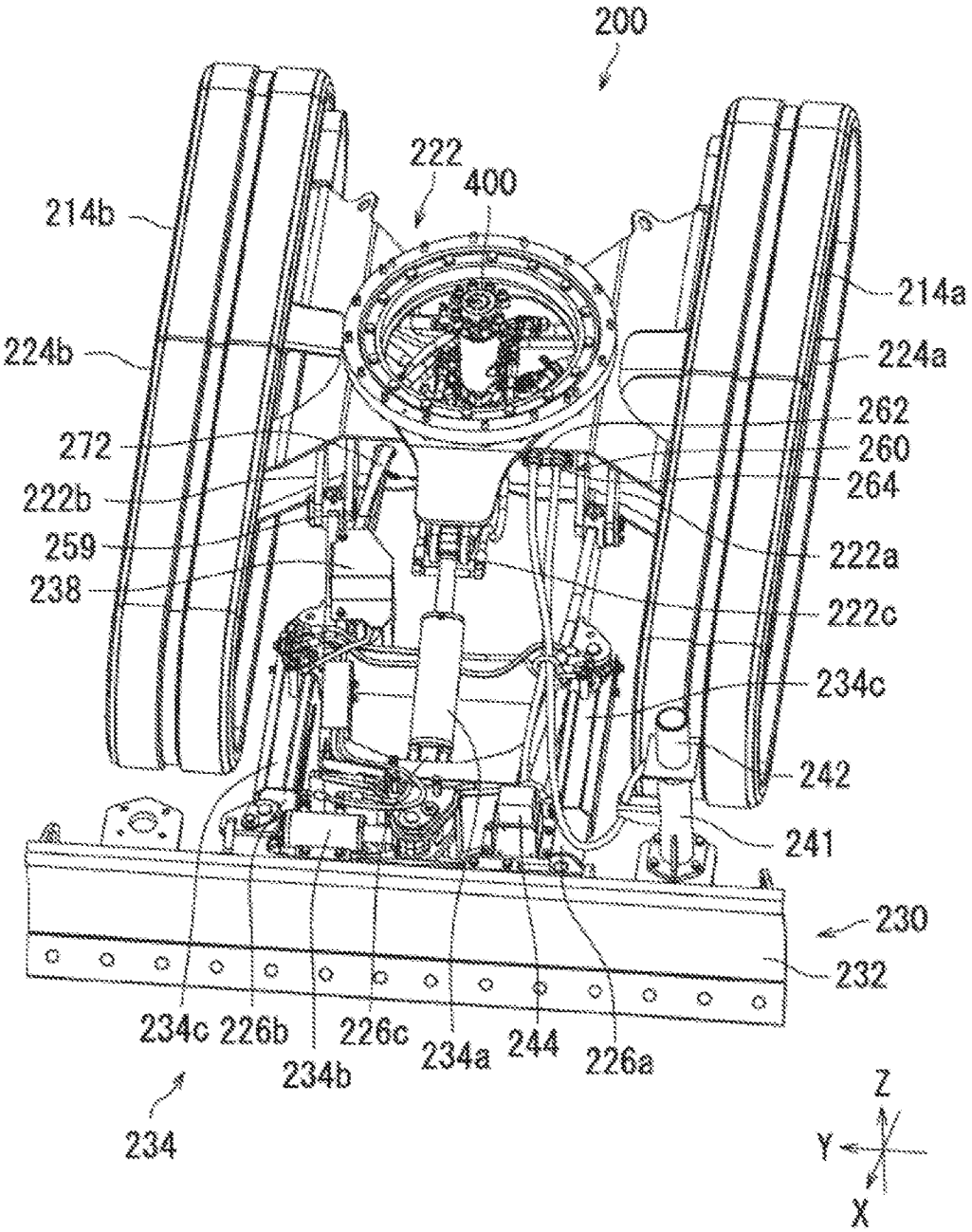
FIG. 10 is a schematic perspective view of the lower traveling body and the rotary coupling member in the construction machine according to the present embodiments.

Next, the construction machine 100 according to the present embodiments will be described with reference to FIG. 1 and FIGS. 7 to 10. FIG. 10 is a schematic perspective view of the lower traveling body 200 and the rotary coupling member 400 in the construction machine 100.

As is illustrated in FIG. 10, the center frame 222 is provided with a pair of pivotally connecting parts 222*a*, 222*b* and an abutting contact part 222*c*. The pair of pivotally connecting parts 222*a* and 222*b* are arranged in parallel in a Y axis direction with respect to the abutting contact part 222*c*. The pivotally connecting part 222*a* is located at a left side toward a progressing direction of the lower traveling body 200, and the pivotally connecting part 222*b* is located at a right side toward the progressing direction of the lower traveling body 200.

The abutting contact part 222*c* protrudes from a front center of the center frame 222. The abutting contact part 222*c* is located between the pair of pivotally connecting parts 222*a* and 222*b*. Arms 226*a* and 226*b* are pivotally connected to the pivotally connecting parts 222*a* and 222*b*. The pair of pivotally connecting parts 222*a* and 222*b* are respectively disposed at either of a right side or a left side of the abutting contact part 222*c* and can be pivotally connected to the earth removal mechanism 230 in a freely elevatable manner.

The blade cylinder 234 includes a lift cylinder 234*a*, a tilt cylinder 234*b*, and an angle cylinder 234*c*. The lift cylinder 234*a* is attached to the abutting contact part 222*c*. The angle cylinder 234*c* is attached to the arms 226*a* and 226*b*.

One end of the lift cylinder 234*a* is connected to the blade 232, and the other end of the lift cylinder 234*a* is connected to the abutting contact part 222*c*. The abutting contact part 222*c* is pivotally connected to the lift cylinder 234*a* together with the blade 232.

The angle cylinder 234*c* is located at both sides of the lift cylinder 234*a*. One end of the angle cylinder 234*c* is connected to the blade 232, and the other end of angle cylinder 234*c* is connected to the pivotally connecting parts 222*a* and 222*b*, respectively. The pivotally connecting parts 222*a* and 222*b* are pivotally connected to the angle cylinder 234*c* together with the blade 232.

The relay member 260 is mounted in front of the center frame 222. The relay member 260 is disposed between the pivotally connecting part 222*a* and the abutting contact part 222*c* of the center frame 222.

There are disposed between the pivotally connecting part 222*a* and the abutting contact part 222*c* the first connector 262 and the second connector 264 of the relay member 260. This results in that the first connector 262 and the second connector 264 connectors are less likely to come into contact with obstacles to reduce a risk of breakage thereof. In addition, in a case where an operator removes the cables 252 and 254, workspace for the operator can be provided between the earth removal mechanism 230 and the center frame 222, thereby enabling the operator to remove the cables 252 and 254 easily. The cables 252 and 254 that extend from the first connector 262 and the second connector 264, respectively pass above the arm 226*a* to the prism 242 and/or the angle sensor 244.

Furthermore, a cable guide is provided above the arm 226*a* so as to prevent breakage of the cables 252 and 254. In a case where a hydraulic cylinder, such as the angle cylinder 234*c*, is disposed outside a vertical plate that forms the arm 226*a*, a hose guide may be attached to a cylinder cover that protects a hydraulic cylinder lot.

It is preferable that the blade cylinder 234 would include the tilt cylinder 234*b* and the angle cylinder 234*c*. The tilt cylinder 234*b* is mounted on a tip of the arm 226*b*. The tilt cylinder 234*b* allows the blade 232 to be freely mounted up and down so as to perform a tilt operation as well as to be freely mounted back and forth so as to perform an angle operation. The tilt cylinder 234*b* pivotally connects and couples the back surface of blade 232 with an upper part of the tit of the arm 226*b*.

The angle cylinder 234*c* pivotally connects and couples outsides of the arms 226*a* and 226*b* with the back surface of the blade 232. A pipe at a rod side, which is disposed at a bottom side of the tilt cylinder 234*b* and the angle cylinder 234*c*, is mounted on a back surface of the other vertical plate with respect to one vertical plate of the arm passed by a cable of the detection device 240 so as to be connected to a selector valve 238. In addition, this pipe is connected to two hydraulic pipes that connect to a control valve extending from between the abutting contact part 222*c* and the pivotally connecting part 222*b* of the center frame 222 and the cable 259 that transfers switching signals of a solenoid valve that switches a valve position of the selector valve 238.

The switching signals causes oil flowing from the control valve to be sent to either tilt cylinder 234*b* or the angle cylinder 234*c*. Extension parts of these pluralities of pipes and mounting positions of the first connector 262 and the second connector 264 are divided by the abutting contact part 222*b* into a separate area, which leads to improvement on workability of attaching and detaching the first connector 262 and the second connector 264 for the operator.

It is noted that a method for switching a valve position of the selector valve 238 can be executed by a pilot type switching valve instead of a solenoid valve. In this case, instead of cables that transfers signals, two hydraulic hoses, which form a pilot oil channel supplying pilot pressure and a pilot discharge oil channel.

As is described above with reference to FIGS. 1 to 6, the rotary joint 420 connects the oil channels of the upper swiveling body 300 to those of the lower traveling body 200. The rotary joint 420 includes the body 412 in a cylindrical shape and the shaft 414 that is rotatably fit into the body 412. In addition, the shaft 414 has the vertical holes 414*p* circumferentially opened therein, and there are provided above the vertical holes 414*p* a horizontal hole 414*r* that is coupled with an oil channel at a side of the upper swiveling body 300, and there are formed below the vertical holes 414*p* and at the main body part 412*a* the horizontal holes 412*p* that are coupled with the scribed and provided circumferentially channels, the channels being coupled with oil channels at a side of the lower traveling body 200. There are provided downward from above the main body part 412*a* from upward to downward a plurality of oil channels that are scribed and provided circumferentially, the individual channels being provided for each channel corresponding to an actuator installed in the lower traveling body 200, and the above and below oil channels are sealed by an o-ring therebetween. The fixing part 412*b* which is located at a lower part of the main body part 412*a* is fastened by a bolt to the bottom surface of the center frame 222, and the tip of the shaft 414 penetrates the fixing part 412*b* from the main body part 412*a*, a diameter of the tip being smaller than a diameter of the shaft 414 which is fit into the main body part 412*a*. There is provided at the central part of the shaft 414 the communication hole 414*q* that penetrates the upper end part and the lower end part of the shaft 414, and the communication hole 414*q* allows the cable 340 extending from the rotary joint 420 to pass therethrough. In addition, the shaft 414 swivels integrally with the upper swiveling body 300 by means of the detent part 414*t* attached to the upper swiveling body 300.

As is described above, the rotary joint 420 may include a slip ring. However, the rotary joint 420 may include a contactless power feeding device, and the contactless power feeding device may supply power to the detection device 240. For example, the rotary joint 420 may provide power to the detection device 240 by magnetic induction.

It is noted that in a case where the rotary joint 420 includes a slip ring, as is described above, the rotary joint 420 includes a rotatable ring part and a brush part sliding around the ring part. The wiring extending from the ring part is electrically connected to the wiring extending from the brush part. The ring part is integrated with the shaft part and rotates within the case part that houses the brush part.

Power supplied to the prism 242 is supplied from a predetermined power source disposed in the upper swiveling body 300 via the rotary joint 420. In addition, signals detected by the angle sensor 244 are transmitted to the controller 320 via the rotary joint 420. Switching signals form a changeover switch of the selector valve 238 are sent to the solenoid valve of the selector valve 238 via the swivel joint.

The relay member 260 is mounted in front of the center frame 222, which is located at a middle of the pair of the right and left side frames 224*a* and 224*b* of the lower traveling body 200. This can facilitate attaching and detaching the cable 340.

The relay member 260 is mounted between the pivotally connecting part 222*a* and the abutting contact part 222*c*. This not only allows the cables 252 and 254 to be easily attached and detached but also makes it possible to dispose the first connector 262 and the second connector 264 at a position where the connectors are less likely to come in contact with obstacles, which results in being capable of preventing breakage of the first connector 262 and the second connector 264.

In front of the center frame 222, a drive system cable 272 extends from between the pivotally connecting part 222*b* and the abutting contact part 222*c*. The drive system cable 272 includes hydraulic hoses for driving the blade 232. The hydraulic pressure flowing through the hydraulic hose in the drive system cable 272 can control a position and/or a posture of the blade 232. Alternatively, the drive system cable 272 may include a cable for driving the blade 232.

The drive system cable 272 is basically configured so as not to be capable of being attached or detached. Therefore, it is possible to dispose the drive system cable 272 and the cables 252 and 254 that can be attached to or detached from the first connector 262 and the second connector 264 of the relay member 260 so as to be spatially divided by the abutting contact part 222*c*. This can facilitate attaching and detaching the cables 252 and 254.

It is preferable that the blade cylinder 234 would include at least one of the tilt cylinder 234*b* and the angle cylinder 234*c*. In this case, the drive system cable 272 preferably includes at least one of a hydraulic hose that is in communication with the angle cylinder 234*c* and a hydraulic hose that is in communication with the tilt cylinder 234*b*.

The earth removal mechanism 230 preferably includes a tilt cylinder 234*b* or an angle cylinder 234*c*. Alternatively, the earth removal mechanism 230 may include the selector valve 238 that switches a flow of hydraulic pressure toward either the tilt cylinder 234*b* or the angle cylinder 234*c*. In this case, it is preferable that the drive system cable 272 would include the hydraulic hose that is in communication with the selector valve 238 and the cable 259 that transmits switching signals to the selector valve 238.

As is described with reference to FIGS. 7 to 10, the detection device 240 detects the position and/or the posture of the blade 232. For example, the detection device 240 detects the position of the blade 232. The construction machine 100 controls operation of the blade 232 on the basis of a difference between the position information and the three-dimensional design data of the detected blade 232 to perform automatic laying-leveling work. For example, in automatic laying-leveling work, the total station measures position information of the prism 242 and transmits the position information to a radio attached to a bracket erected in the rear of the steering unit 310. For this purpose, position information of the construction machine 100 is input to the controller 320.

Furthermore, the angle sensor 244 measures vertical movement (tilt angle) caused by tilt operation of the blade 232 and outputs the measurement results to the controller 320. The controller 320 calculates position information of the blade 232 on the basis of these pieces of information and sends control signals from the controller 320 to the solenoid proportional valve in communication with the input port of pilot pressure of a direction switching valve that controls the lift cylinder 234*a* and the tilt cylinder 234*b* on the basis of a difference in design data to carry out automatic control.

Alternatively, automatic laying-leveling may be performed jointly with other construction machines in combination with other total stations and the prism 242 at a single construction site. In this case, each 242 prism needs to have an individual ID and transmit the ID information to the corresponding total station. Thus, the prism 242 is supplied with power via the cable 252. It is noted that position information measured by the total station is input to the controller 320 mounted on the upper swiveling body 300 via radio.

Additionally, the angle sensor 244 is connected to the upper swiveling body 300 via the cable 254 for transmitting angle information to the controller 320 installed on the upper swiveling body 300. The angle sensor 244 is located adjacent to a pivotally connecting part that allows angle operation of rotating the blade 232 back and forth to be performed. At a back side of the blade 232, the angle sensor 244 is installed on a stay that is formed by welding L-shaped steel at a portion higher than a position at the middle of the blade 232 height. The angle sensor 244 is covered from the above by a box. A connector part of the cable that outputs detection data protrudes from a rear of the angle sensor 244. An upper part of the box is covered from the above by a cover member that covers the tilt cylinder 234*b*. This configuration protects the angle sensor 244 from earth and sand crawling up from below the back surface of the blade 232 or spilling over from the above during laying-leveling work.

The pillar 241 and the prism 242 are attachable to and detachable from the blade 232. Since the prism 242 is relatively expensive, the prism 242 is typically removed after completion of construction of a day to prevent a theft. At that time, the cable 252 connecting the prism 242 to the lower traveling body 200 is removed from the first connector 262 attached to the lower traveling body 200.

It is noted that the detection device 240 includes a prism 242 and an angle sensor 244, which are not limited to by the present embodiments. The detection device 240 may include at least one of the prism 242 and the angle sensor 244. Alternatively, the detection device 240 may include another element or sensor together with the prism 242 and the angle sensor 244. The detection device 240 may also include another element or sensor in place of the prism 242 and the angle sensor 244.

For example, a global positioning satellite system (Global Navigation Satellite System: GNSS) antenna may be used in place of the prism 242. In this case, the position information of the blade 232 can be calculated, without a total station, from position information of the GNSS antenna input directly from the GNSS antenna to the controller 320 (FIGS. 1(*a*) and 7) via a cable and position information of the tilt angle which has been detected separately. Therefore, the detection device 240 is not limited to the prism 242 and the angle sensor 244; but may be a GNSS antenna or an acceleration sensor. Even in this case, the detection device 240 should be coupled with electrical components including the controller 320 installed in the upper swiveling body 300 via the cables 252 and 254.

The embodiments of the present invention have been described hereinabove with reference to the drawings. The present invention is, however, not limited to the above-mentioned embodiments and can be implemented in various manners within a scope not departing from the gist of the present invention. Furthermore, various inventions may be formed by appropriately combining a plurality of elements of configuration disclosed in the above-mentioned embodiments. For example, some may be removed from all of the elements of configuration disclosed in the embodiments. In addition, elements of configuration from different embodiments may be appropriately combined. The drawings mainly and schematically illustrate individual elements of configuration for the purpose of facilitating understanding thereof, and the individual elements of configuration illustrated in the drawings, such as a thickness, a length, the number, and an interval, may differ in practice for the sake of convenience for drawing preparation. Furthermore, elements of configuration described in the above embodiments, such as material, a shape, and a dimension, which are not particularly limited, are one example, and can be variously altered within a scope not substantially departing from effects of the present invention.

INDUSTRIAL APPLICABILITY

The present invention is suitably used for a construction machine.

DESCRIPTION OF REFERENCE NUMERALS

100 construction machine
200 lower traveling body
230 earth removal mechanism
300 upper swiveling body
320: work machine
400 rotary coupling member
410 swivel joint
420 rotary joint

The invention claimed is:

1. A construction machine comprising:
a lower traveling body;
an upper swiveling body; and
a rotary coupling member configured to swivel together with the upper swiveling body with respect to the lower traveling body,
wherein the rotary coupling member includes:
a swivel joint having a body and a shaft, the body having a through hole, and the shaft being disposed at the through hole of the body, rotatable with respect to the body, and provided with a communication hole;
a rotary joint including a rotor element, a stator element, and a terminal part disposed in the stator element, the rotor element being configured to rotate together with the shaft;
a cable that extends through the communication hole of the shaft and is electrically connected to the terminal part;
a coupling part coupled with at least one of the rotor element and the shaft; and
a detent part that is fixed to the body and is configured to restrict rotation of the terminal part of the rotary joint.

2. The construction machine according to claim 1, wherein the rotary joint is located at a lower end of the swivel joint.

3. The construction machine according to claim 1, wherein the coupling part is connected to a lower end of the shaft.

4. The construction machine according to claim 1, wherein the body includes:
a main body part provided with an oil channel that is configured to communicate between the upper swiveling body and the lower traveling body; and
a fixing part to which the detent part is attached and by which the main body part is fixed to the lower traveling body.

5. The construction machine according to claim 4, wherein the shaft penetrates the main body part and the fixing part of the body, with a diameter of a portion of the shaft that penetrates the fixing part being smaller than a diameter of a portion of the shaft that penetrates the main body part.

6. The construction machine according to claim 1, wherein the detent part has an engagement part that is configured to contact the terminal part of the rotary joint.

7. The construction machine according to claim 1, wherein the coupling part is provided with a communicating hole that is configured to communicate the inside of the coupling part with the outside of the coupling part.

8. The construction machine according to claim 7, wherein:
the rotor element includes a main part and a flange part having a diameter larger than a diameter of the main part provided at a portion which comes into contact with the coupling part,
the flange part being provided with a bolt hole for fixing to the coupling part, and
the coupling part including:
a through hole that penetrates a center of the coupling part;
a recess that is provided in communication with the through hole of the coupling part, is inside a portion joined to the flange part, and is configured to communicate with the communicating hole; and
a bolt hole that is provided at a bottom surface of the recess.

9. The construction machine according to claim 1, wherein the detent part is configured to restrict rotation of the terminal part of the rotary joint by contacting the terminal part or the stator element.

10. The construction machine according to claim 1, wherein the detent part restricts rotation of the terminal part while the rotor element rotates.

11. The construction machine according to claim 1, wherein:
the detent part includes a first member and a second member, and
the terminal part is disposed within a space between the first member and the second member.

12. The construction machine according to claim 1, wherein:
the detent part includes a first member and a second member spaced apart from one another, and
the rotation of the terminal part is restricted by the terminal part contacting the first member or the second member.

* * * * *